US005158666A

United States Patent [19]

Reid

[11] Patent Number: 5,158,666

[45] Date of Patent: Oct. 27, 1992

[54] USE OF 1-(2-AMINOETHYL) PIPERAZINE TO INHIBIT HEAT EXCHANGE FOULING DURING THE PROCESSING OF HYDROCARBONS

[75] Inventor: Dwight K. Reid, Houston, Tex.

[73] Assignee: Betz Laboratories, Inc., Trevose, Pa.

[21] Appl. No.: 566,648

[22] Filed: Aug. 13, 1990

[51] Int. Cl.[5] ..... G10G 9/16

[52] U.S. Cl. ..... 208/48 AA; 585/2; 44/335

[58] Field of Search ..... 208/48 AA; 585/2; 44/335

[56] References Cited

U.S. PATENT DOCUMENTS

| | | | |
|---|---|---|---|
| 2,329,251 | 9/1943 | Chenicek | 44/66 |
| 3,218,322 | 11/1965 | Orloff | 585/5 |
| 3,558,470 | 1/1971 | Gillespie | 208/48 AA |
| 4,200,518 | 4/1980 | Mulvany | 208/48 AA |
| 4,319,063 | 3/1982 | Droracek et al. | 208/48 AA |
| 4,390,412 | 6/1983 | Droracek et al. | 208/48 AA |
| 4,431,514 | 2/1984 | Ferm | 208/48 AA |
| 4,647,290 | 3/1987 | Reid | 44/57 |
| 4,714,793 | 12/1987 | van Eijl | 585/2 |
| 4,744,881 | 5/1988 | Reid | 208/48 |
| 4,749,468 | 6/1988 | Roling et al. | 208/48 AA |
| 4,810,354 | 3/1989 | Roling et al. | 208/48 AA |
| 4,867,754 | 9/1989 | Reid | 44/72 |

OTHER PUBLICATIONS

Standard Methods for Analysis and Testing of Petroleum and Related Products, vol. 1, 1988 pp. 130.15–130.16.

*Primary Examiner*—Theodore Morris
*Assistant Examiner*—William C. Diemler
*Attorney, Agent, or Firm*—Alexander D. Ricci; Philip H. Von Neida

[57] ABSTRACT

The present invention is directed to an antioxidant material and its use in petroleum and petrochemical processes to reduce and/or control fouling problems specifically as regards hydrocarbons having a bromine number of 10 or less and containing oxygen. The inventive antioxidant material is 1-(2-aminoethyl) piperazine.

5 Claims, No Drawings

USE OF 1-(2-AMINOETHYL) PIPERAZINE TO INHIBIT HEAT EXCHANGE FOULING DURING THE PROCESSING OF HYDROCARBONS

FIELD OF THE INVENTION

This invention relates to a process for inhibiting and preventing fouling in refinery and petrochemical feedstocks during processing. More particularly, this invention relates to hydrocarbon fuel fouling, manifested by color degradation, particulate formation and gum generation in hydrocarbon fuel oils undergoing petroleum processing.

BACKGROUND OF THE INVENTION

Fouling can be defined as the accumulation of unwanted matter on heat transfer surfaces. This deposition can be very costly in refinery and petrochemical plants since it increases fuel usage, results in interrupted operations and production losses and increases maintenance costs.

Deposits are found in a variety of equipment preheat exchangers, overhead condensers, furnaces, heat exchangers, fractionating towers, reboilers, compressors and reactor beds. These deposits are complex but they can be broadly characterized as organic and inorganic. They consist of metal oxides and sulfides, soluble organic metals, organic polymers, coke, salt and various other particulate matter. Chemical antifoulants have been developed that effectively combat fouling.

The chemical composition of organic foulants is rarely identified completely. Organic fouling is caused by insoluble polymers which sometimes are degraded to coke. The polymers are usually formed by reactions of unsaturated hydrocarbons, although any hydrocarbon can polymerize. Generally, olefins tend to polymerize more readily than aromatics, which in turn polymerize more readily than paraffins. Trace organic materials containing hetero atoms such as nitrogen, oxygen and sulfur also contribute to polymerization.

Polymers are generally formed by free radical chain reactions. These reactions, shown below, consist of two phases, an initiation phase and a propagation phase. In Reaction 1, the chain initiation reaction, a free radical represented by R., is formed (the symbol R. can be any hydrocarbon). These free radicals, which have an odd electron, act as chain carriers. During chain propagation, additional free radicals are formed and the hydrocarbon molecules (R) grow larger and larger (see Reaction 4), forming the unwanted polymers which accumulate on heat transfer surfaces.

Chain reactions can be triggered in several ways. In Reaction 1, heat starts the chain. Example: When a reactive molecule such as an olefin or a diolefin is heated, a free radical is produced. Another way a chain reaction starts is shown in Reaction 3. Metal ions initiate free radical formation here. Accelerating polymerization by oxygen and metals can be seen by reviewing Reactions 2 and 3.

As polymers form, more polymers begin to adhere to the heat transfer surfaces. This adherence results in dehydrogenation of the hydrocarbon and eventually the polymer is converted to coke.

1. Chain Initiation
   R—H - - - R.+H.
2. Chain Propagation
   a. R.+$O_2$- - - R—O—O.

b. R—O—O.+R'—H - - - R.+R—O—O—H
3. Chain Initiation
   a. $Me^{++}$+RH - - - $Me^{+}$R.+$H^{+}$
   b. $Me^{++}$+R—O—O—H - - - $Me^{+}$ R—O—O.+$H^{+}$
4. Chain Termination
   a. R.+R. - - - R—R'
   b. R.+R—O—O. - - - R—O—O—R In refineries, deposits usually contain both organic and inorganic compounds. This makes the identification of the exact cause of fouling extremely difficult. Even if it were possible to precisely identify every single deposit constituent, this would not guarantee uncovering the cause of the problem. Assumptions are often erroneously made that if a deposit is predominantly a certain compound, then that compound is the cause of the fouling. In reality, oftentimes a minor constituent in the deposit could be acting as a binder, a catalyst, or in some other role that influences actual deposit formation.

The final form of the deposit as viewed by analytical chemists may not always indicate its origin or cause. Before openings, equipment is steamed, waterwashed, or otherwise readied for inspection. During this preparation, fouling matter can be changed both physically and chemically. For example, water-soluble salts can be washed away or certain deposit constituents oxidized to another form.

In petrochemical plants, fouling matter is often organic in nature. Fouling can be severe when monomers convert to polymers before they leave the plant. This is most likely to happen in streams high in ethylene, propylene, butadiene, styrene and other unsaturates. Probable locations for such reactions include units where the unsaturates are being handled or purified, or in streams which contain these reactive materials only as contaminants.

Even through some petrochemical fouling problems seem similar, subtle differences in feedstock, processing schemes, processing equipment and type of contaminants can lead to variations in fouling severity. For example, ethylene plant depropanizer reboilers experience fouling that appears to be primarily polybutadiene in nature. The severity of the problem varies significantly from plant to plant, however. The average reboiler run length may vary from one to two weeks up to four to six months (without chemical treatment).

Although it is usually impractical to identify the fouling problem by analytical techniques alone, this information combined with knowledge of the process, processing conditions and the factors known to contribute to fouling, are all essential to understanding the problem.

There are many ways to reduce fouling both mechanically and chemically. Chemical additives often offer an effective anti-fouling means; however, processing changes, mechanical modifications equipment and other methods available to the plant should not be overlooked.

Antifoulant chemicals are formulated from several materials: some prevent foulants from forming, others prevent foulants from depositing on heat transfer equipment. Materials that prevent deposit formation include antioxidants, metal coordinators and corrosion inhibitors. Compounds that prevent deposition are surfactants which act as detergents or dispersants. Different combinations of these properties are blended together to maximize results for each different application. These "polyfunctional" antifoulants are generally more versatile and effective since they can be designed to combat various types of fouling that can be present in any given system.

Research indicates that even very small amounts of oxygen can cause or accelerate polymerization. Accordingly, anti-oxidant-type antifoulants have been developed to prevent oxygen from initiating polymerization. Antioxidants act as chain-stoppers by forming inert molecules with the oxidized free radical hydrocarbons, in accordance with the following reaction:

Chain Termination

ROO·Antioxidant - - - ROOH + Antioxidant (H)

Surface modifiers or detergents change metal surface characteristics to prevent foulants from depositing. Dispersants or stabilizers prevent insoluble polymers, coke and other particulate matter from agglomerating into large particles which can settle out of the process stream and adhere to the metal surfaces of process equipment. They also modify the particle surface so that polymerization cannot readily take place.

Antifoulants are designed to prevent equipment surfaces from fouling. They are not designed to clean up existing foulants. Therefore, an antifoulant should be started immediately after equipment is cleaned. It is usually advantageous to pretreat the system at double the recommended dosage for two or three weeks to reduce the initial high rate of fouling immediately after startup.

The increased profit possible with the use of antifoulants varies from application to application. It can include an increase in production, fuel savings, maintenance savings and other savings from greater operating efficiency.

There are many areas in the hydrocarbon processing industry where antifoulants have been used extensively; the main areas of treatment are discussed below.

In a refinery, the crude unit has been the focus of attention because of increased fuel costs. Antifoulants have been successfully applied at the exchangers; downstream and upstream of the desalter, on the product side of the preheat train, on both sides of the desalter makeup water exchanger and at the sour water stripper.

Hydrodesulfurization units of all types experience preheat fouling problems. Among those that have been successfully treated are reformer pretreaters processing both straight run and coker naphtha, desulfurizers processing catalytically cracked and coker gas oil, and distillate hydro-treaters. In one case, fouling of a Unifiner stripper column was solved by applying a corrosion inhibitor upstream of the problem source.

Unsaturated and saturated gas plants (refinery vapor recovery units) experience fouling in the various fractionation columns, reboilers and compressors. In some cases, a corrosion control program combined with an antifoulant program gave the best results. In other cases, an application of antifoulants alone was enough to solve the problem.

Cat cracker preheat exchanger fouling, both at the vacuum column and at the cat cracker itself, has also been corrected by the use of antifoulants.

The two most prevalent areas for fouling problems in petrochemical plants are at the ethylene and styrene plants. In an ethylene plant, the furnace gas compressors, the various fractionating columns and reboilers are subject to fouling. Polyfunctional antifoulants, for the most part, have provided good results in these areas. Fouling can also be a problem at the butadiene extraction area. Both antioxidants and polyfunctional antifoulants have been used with good results.

In the different design butadiene plants, absorption oil fouling and distillation column and reboiler fouling have been corrected with various types of antifoulants.

Chlorinated hydrocarbon plants, such as VCM, EDC and perchloroethane and tri-chloroethane have all experienced various types of fouling problems. The metal coordinating/antioxidant-type antifoulants give excellent service in these areas.

SUMMARY OF THE INVENTION

This invention relates to processes for inhibiting the degradation, particulate and gum formation in hydrocarbons prior to or during processing which comprises adding to the hydrocarbons an effective inhibiting amount of an antioxidant, 1-(2-aminoethyl) piperazine (AEP). More particularly, this invention relates to inhibiting the degradation, particulate and gum formation in hydrocarbons that have a bromine number of 10 or less prior to or during processing at elevated temperatures.

Accordingly, it is an object of the present invention to provide processes for inhibiting the degradation, particulate and gum formation in hydrocarbon fuels prior to or during processing.

It is a further object of the present invention to inhibit fouling in petroleum and hydrocarbon petrochemicals during processing.

It is still a further object of the present invention to inhibit fouling in hydrocarbons having a bromine number of 10 or less.

It is still another object of the present invention to inhibit fouling in hydrocarbons through the use of a single chemical.

These and other objects and advantages of the present invention will be apparent to those skilled in the art upon reference to the following description of the preferred embodiments.

THE PRIOR ART

U.S. Pat. No. 4,744,881 (Reid) teaches the use of a composition of an unhindered or hindered phenol and a strongly basic amine compound to control fouling in hydrocarbon fluids having a bromine number greater than 10. This patent discloses N-(2-aminoethyl) piperazine as one of the amines that can be utilized in the process.

U.S. Pat. No. 2,329,251 (Chenicek) teaches an early method of inhibiting gum formation in hydrocarbon distillates using an alkylene polyamine salt of an organic acid.

U.S. Pat. No. 4,647,290 (Reid) teaches the use of a composition of N-(2-aminoethyl) piperazine and N,N-diethylhydroxylamine to inhibit color deterioration of distillate fuel oils. The combination of these two chemicals provide a more effective color stabilized composition than when either is used alone.

U.S. Pat. No. 4,867,754 (Reid) teaches the use of a composition of a phosphite compound and an organic compound containing a tertiary amine of the formula $T_3N$ to stabilize distillate fuel oils. 2-(aminoethyl) piperazine is disclosed as one of the possible amines used. This combination provides a higher degree of stabilizaion of distillate fuel oils than when the individual species are used alone.

DETAILED DESCRIPTION OF THE INVENTION

This invention relates to the inhibition of fouling of heat transfer surfaces during the processing of a hydrocarbon having a bromine number of 10 or less. The hydrocarbon contains substituents which are induced by oxygen to react to form fouling materials in contact with the heat transfer surfaces. This method consists essentially of adding to the petroleum or hydrocarbon system being processed a sufficient amount for the purpose of 1-(2-aminoethyl) piperazine (AEP).

The use of aminoethyl piperazine (AEP) is known in the petroleum refining industry as an antioxidant in hydrocarbon processing. U.S. Pat. No. 4,744,881 (Reid) which is wholly incorporated by reference herein teaches the use of a composition of an unhindered or hindered phenol and a strongly basic amine compound to control fouling in high temperatures hydrocarbon fluids having a bromine number greater than ten. U.S. Pat. No. 4,647,290 (Reid) which is wholly incorporated by reference herein teaches the use of a composition of N-(2-aminoethyl) piperazine and N,N-diethylhydroxylamine to inhibit color deterioration of distillate fuel oils.

Reid ('881) teaches the use of a synergistic composition of a phenol and an amine to control fouling in hydrocarbon fluids having bromine numbers in excess of 10. At column 6, line 13 of Reid ('881), test results indicate that AEP is a poor antioxidant in higher bromine number hydrocarbon fluids when used alone. There is nothing in the specification nor the test results in Reid ('881) that would suggest that AEP, acting alone, would be a good antioxidant in hydrocarbon fluids having bromine numbers less than 10.

Reid ('290) is directed towards color inhibition in distillation fuel oils through the synergistic combination of N-(2-aminoethyl) piperazine and N,N-diethylhydroxyolamine. Reid ('290) teaches in Col. 5, lines 41–45 and Col. 6, lines 1–2 that neither of these two chemical species, when used alone, are effective antioxidants in the hydrocarbon systems taught in Reid ('290). This patent is also directed towards finished products that are in transit or storage and their protection from color contamination. The present invention is directed to hydrocarbons that are undergoing petroleum refining.

Surprisingly, the present inventor has discovered that 1-(2-aminoethyl) piperazine is effective as an antifoulant in hydrocarbons having a bromine number of 10 or less. This is defined as the number of centigrams of bromine which are reacted with 1 gram of hydrocarbon under certain conditions. As compared with the prior art, this antioxidant works well as an antifoulant in hydrocarbons without the use of other chemicals.

The treatment range for AEP clearly is dependent upon the severity of the fouling problem due to free radical polymerization encountered as well as the activity of the AEP utilized. For this reason, the success of the treatment is totally dependent upon the use of a sufficient amount of the AEP. Broadly speaking, the treatment recommendations could be in the range of 1 to 10,000 parts per million (ppm) of petroleum or petrochemical being processed with perhaps 15 to 200 ppm being applicable in most cases. The AEP can be added to the hydrocarbon either as a concentration or as a solution using a suitable carrier solvent which is compatible with the AEP and the hydrocarbon.

The hydrocarbons where the present invention is effective are those which contain unsaturated or olefinic components which components are induced by the presence of oxygen to polymerize or react. As a general rule, any hydrocarbon media having a bromine number of 10 or less would be such where fouling due to oxygen induced reactions would be a problem. These hydrocarbons, where such is the case, include the middle distillate feedstocks such as light cycle oils and cyclo-paraffins that have a bromine number of 10 or less.

In order to more clearly illustrate this invention, the data set forth below was developed. The following examples are included as being illustrations of the invention and should not be construed as limiting the scope thereof.

EXAMPLES

Tests were conducted to study the effect of various additives and AEP on the amount of gum formed in various distillate products in a three hour reflux test. The results appear in Tables I–IV below.

The test procedure employed was a modified version of ASTM 381. A 50 ml refluxed fuel sample in a 100 ml beaker was concentrated in a gum bath (temperature 240° C.) through Jet evaporation to 20 ml and allowed to cool for 30 minutes. The 20 ml sample was transferred to a 120 ml centrifuge tube containing 80 ml of heptane and centrifuged for 8 to 10 minutes. The 100 ml mixture was filtered through a 0.8 micron glass fiber filter. The residual material in the beaker was weighed and this value recorded. The precipitate on the filter was weighed and recorded. The sum of both multiplied by two is taken to be total gum solids in mg/100 ml.

TABLE 1

DHT Tops
HDS Feedstock (West Coast) Refinery
Additives used at 1000 ppm active
Bromine Number = 7.3

| Treatment | Total Washed Gums (mg/100 ml) |
|---|---|
| Control (Avg. 5) | 45.0 |
| Diethylethanolamine | 75.0 |
| 1-(2-aminoethyl) piperazine | 8.0 |

TABLE II

Catalytic Crack Light Gas Oil
Midwestern Refinery Feedstock
Additives used at 750 ppm active
Bromine Number = 7.0

| Treatment | Total Washed Gums (mg/100 ml) |
|---|---|
| Control | 99.0 |
| DEHA | 142.0 |
| ACS-1246 | 148.0 |
| Inhibitor B | 110.0 |
| 1-(2-aminoethyl) piperazine | 38.0 |

TABLE III

Heavy Gas Oil
West Coast Refinery
Additives used at 750 ppm active
Bromine Number = 1

| Treatment | Total Washed Gums (mg/100 ml) |
|---|---|
| Control (Avg. 4) | 156.0 |
| 1-(2-aminoethyl) piperazine | 95.0 |

TABLE IV

| Virgin Light Gas Oil Feedstock<br>West Coast Refinery<br>Additives used at 750 ppm active<br>Bromine Number = 1 | |
|---|---|
| Treatment | Total Washed Gums (mg/100 ml) |
| Control | 407 |
| Inhibitor A | 418 |
| 1-(2-aminoethyl) piperazine | 172 |

Inhibitor A is a commercial substituted p-phenylene diamine/phosphite antioxidant The results in Tables I–IV indicate the substantially better performance of AEP in inhibiting gum formation compared with other commercial antifoulants. The less gums that are accumulated in the wash, the more efficacious the treatment agent.

While this invention has been described with respect to particular embodiments thereof, it is apparent that numerous other forms and modifications of this invention will be obvious to those skilled in the art.

What I claim is:

1. A method of inhibiting fouling of heat transfer surfaces during the processing of a hydrocarbon in contact with said heat transfer surfaces, said hydrocarbon having a bromine number of 10 or less and containing unsaturated or olefinic components which are induced by the presence of oxygen to react to form fouling materials, which consists essentially of adding to said hydrocarbon being processed a sufficient amount, for the purpose of inhibiting fouling, of 1-(2-aminoethyl) piperazine (AEP).

2. A method according to claim AEP is added to said hydrocarbon in an amount of from 1 to 10,000 ppm of the petroleum or hydrocarbon petrochemical being processed.

3. A method according to claim 2 wherein the AEP is added to said hydrocarbon in an amount of from 15 to 200 ppm of the petroleum or hydrocarbon petrochemical being processed.

4. A method according to claim 1 wherein said heat transfer surfaces are heat exchangers.

5. A method according to claim 1 wherein the AEP is in an organic solvent.

* * * * *